US010378287B2

(12) United States Patent
Thomas et al.

(10) Patent No.: US 10,378,287 B2
(45) Date of Patent: Aug. 13, 2019

(54) METHODS OF REMOVING SHOULDER POWDER FROM FIXED CUTTER BITS

(71) Applicant: Halliburton Energy Services, Inc., Houston, TX (US)

(72) Inventors: Jeff G. Thomas, Magnolia, TX (US); Garrett T. Olsen, The Woodlands, TX (US); Grant O. Cook, III, Spring, TX (US); Daniel Brendan Voglewede, Spring, TX (US); Yi Pan, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 328 days.

(21) Appl. No.: 15/307,145

(22) PCT Filed: May 17, 2016

(86) PCT No.: PCT/US2016/032880

§ 371 (c)(1),
(2) Date: Oct. 27, 2016

(87) PCT Pub. No.: WO2161/187202

PCT Pub. Date: Nov. 24, 2016

(65) Prior Publication Data

US 2017/0159367 A1 Jun. 8, 2017

Related U.S. Application Data

(60) Provisional application No. 62/163,207, filed on May 18, 2015.

(51) Int. Cl.
*B22D 19/02* (2006.01)
*B22D 19/14* (2006.01)
(Continued)

(52) U.S. Cl.
CPC ..... *E21B 10/54* (2013.01); *B22D 23/06* (2013.01); *B22D 25/02* (2013.01); *B22F 7/06* (2013.01);
(Continued)

(58) Field of Classification Search
CPC ..... B22D 19/00; B22D 19/02; B22D 19/14; B22D 23/06; B22D 25/02
(Continued)

(56) References Cited

U.S. PATENT DOCUMENTS 5,373,907 A 12/1994 Weaver
7,398,840 B2 7/2008 Ladi et al.
(Continued)

FOREIGN PATENT DOCUMENTS

CN 103237617 8/2013
WO 0015942 A1 3/2000

OTHER PUBLICATIONS

Chinese Search Report for Application No. 201680022118.1 dated Sep. 26, 2018.
ISR/WO for PCT/US2016/032880 dated Aug. 25, 2016.

*Primary Examiner* — Kevin P Kerns
(74) *Attorney, Agent, or Firm* — Alan Bryson; C. Tumey Law Group PLLC

(57) ABSTRACT

Tools, for example, fixed cutter drill bits, may be manufactured to include hard composite portions having reinforcing particles dispersed in a continuous binder phase and auxiliary portions that are more machinable than the hard composite portions. For example, a tool may include a hard composite portion having a machinability rating 0.2 or less; and an auxiliary portion having a machinability rating of 0.6 or greater in contact with the hard composite portion. The boundary or interface between the hard composite portion and the auxiliary portion may be designed so that upon
(Continued)

removal of the most or all of the auxiliary portion the resultant tool has a desired geometry without having to machine the hard composite portion.

16 Claims, 4 Drawing Sheets

(51) Int. Cl.

| | |
|---|---|
| ***B22D 23/06*** | (2006.01) |
| ***B22D 25/02*** | (2006.01) |
| ***E21B 10/54*** | (2006.01) |
| ***E21B 10/42*** | (2006.01) |
| ***C22C 1/10*** | (2006.01) |
| ***B22F 7/06*** | (2006.01) |
| ***E21B 10/60*** | (2006.01) |
| *C22C 26/00* | (2006.01) |
| *C22C 29/00* | (2006.01) |
| *C22C 29/06* | (2006.01) |
| *B22F 5/00* | (2006.01) |

(52) U.S. Cl.
CPC ..... *C22C 1/1036* (2013.01); *C22C 1/1094* (2013.01); *E21B 10/42* (2013.01); *E21B 10/602* (2013.01); *B22F 2005/001* (2013.01); *C22C 26/00* (2013.01); *C22C 29/00* (2013.01); *C22C 29/06* (2013.01); *C22C 2001/1047* (2013.01)

(58) Field of Classification Search
USPC ..... 164/91, 97
See application file for complete search history.

(56) References Cited

U.S. PATENT DOCUMENTS

| | | | | |
|---|---|---|---|---|
| 8,475,918 | B2 | 7/2013 | DiGiovanni et al. | |
| 8,858,870 | B2 | 10/2014 | Mirchandani et al. | |
| 9,359,824 | B2 * | 6/2016 | Thigpen et al. ..... | E21B 10/42 |
| 2008/0164070 | A1 | 7/2008 | Keshavan et al. | |
| 2010/0288821 | A1 | 11/2010 | Ladi et al. | |
| 2013/0153306 | A1 | 6/2013 | Burhan et al. | |
| 2013/0156637 | A1 | 6/2013 | Park et al. | |
| 2014/0131115 | A1 | 5/2014 | Thigpen et al. | |
| 2015/0240566 | A1 | 8/2015 | Amundsen et al. | |

* cited by examiner

METHODS OF REMOVING SHOULDER POWDER FROM FIXED CUTTER BITS

BACKGROUND

A wide variety of tools are used downhole in the oil and gas industry, including tools for forming wellbores, tools used in completing wellbores that have been drilled, and tools used in producing hydrocarbons such as oil and gas from the completed wells. Cutting tools, in particular, are frequently used to drill oil and gas wells, geothermal wells and water wells. Examples of such cutting tools include roller cone drill bits, fixed cutter drill bits, reamers, coring bits, and the like. Fixed cutter drill bits, in particular, are often formed with a matrix bit body having cutting elements or inserts disposed at select locations about the exterior of the matrix bit body. During drilling, these cutting elements engage and remove portions of the subterranean formation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
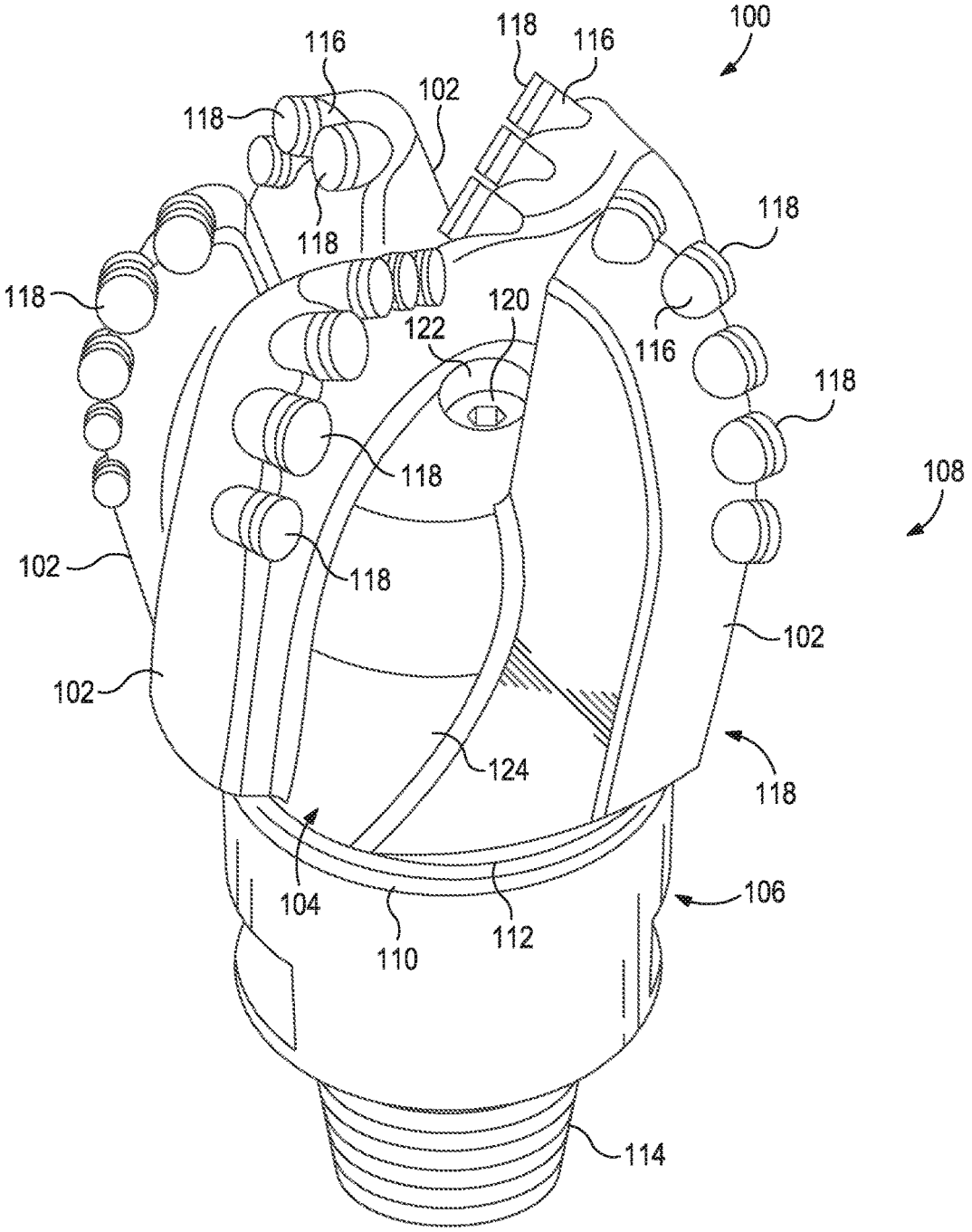
FIG. 1 is a perspective view of an exemplary drill bit that may be fabricated in accordance with the principles of the present disclosure.

The present disclosure relates to tool manufacturing and, more particularly, to fixed cutter drill bits formed of hard composite portions having reinforcing particles dispersed in a continuous binder phase and auxiliary portions that are more machinable than the hard composite portions. For example, the auxiliary portion may have a machinability rating of 0.6 or greater, and the hard composite portion may have a machinability rating of 0.2 or less. As used herein, the term "machinability rating" refers to a rating measured according to the American Iron and Steel Institute (AISI) Machinability Rating Procedure. That procedure sets a machinability rating of 1.00 for 160 Brinel hardness B1112 cold drawn steel machined at 180 surface feet per minute, where materials having a rating less than 1.00 are more difficult to machine and materials having a rating above 1.00 are easier to machine. The boundary or interface between the hard composite portion and the auxiliary portion may be designed so that upon removal of the most or all of the auxiliary portion the resultant tool has a desired geometry without having to machine or with minimal machining of the hard composite portion.

The matrix bit body of a fixed cutter drill bit is formed with a metal matrix composite (MMC) having reinforcing particles dispersed in a continuous binder phase (e.g., tungsten carbide particles dispersed in a copper binder). During fabrication of a matrix bit body, a mold is commonly used to obtain the desired shape of the matrix bit body, and the resulting shape typically includes excess portions that are later machined to produce the matrix bit body. Such machining allows for, among other things, creating features of the matrix bit body with higher tolerances than could be achieved solely with the mold.

MMCs fabricated to provide wear resistance and impact strength are typically too hard to machine. Consequently, a metal powder (e.g., tungsten metal powder) is often mixed with the reinforcing particles to form the MMC, where the softness of the metal powder relative to the reinforcing particles allows the resulting composite material to be machinable. However, the metal powders that enhance machinability in MMCs are also quite expensive and, if used throughout the MMC, would account for approximately 3% of the manufacturing costs. The embodiments disclosed herein describe the use of metal powders and other materials to dope only the specific portions of the MMC that are later machined.

Embodiments of the present disclosure are applicable to any tool or part formed as a metal matrix composite (MMC). For instance, the principles of the present disclosure may be applied to the fabrication of tools or parts commonly used in the oil and gas industry for the exploration and recovery of hydrocarbons. Such tools and parts include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

The principles of the present disclosure, however, may be equally applicable to any type of MMC used in any industry or field. For instance, the methods described herein may also be applied to fabricating armor plating, automotive components (e.g., sleeves, cylinder liners, driveshafts, exhaust valves, brake rotors), bicycle frames, brake fins, wear pads, aerospace components (e.g., landing-gear components, structural tubes, struts, shafts, links, ducts, waveguides, guide vanes, rotor-blade sleeves, ventral fins, actuators, exhaust structures, cases, frames, fuel nozzles), turbopump and compressor components, a screen, a filter, and a porous catalyst, without departing from the scope of the disclosure. Those skilled in the art will readily appreciate that the foregoing list is not a comprehensive listing, but only exemplary. Accordingly, the foregoing listing of parts and/or components should not limit the scope of the present disclosure.

FIG. 1 is a perspective view of an example MMC tool 100 that may be fabricated in accordance with the principles of the present disclosure. The MMC tool 100 is generally depicted in FIG. 1 as a fixed-cutter drill bit commonly used in the oil and gas industry to drill wellbores. Accordingly, the MMC tool 100 will be referred to herein as the "drill bit 100," but as indicated above, the drill bit 100 may alternatively be replaced with any type of MMC tool or part used in the oil and gas industry or any other industry, without departing from the scope of the disclosure.

As illustrated in FIG. 1, the drill bit 100 may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" may be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
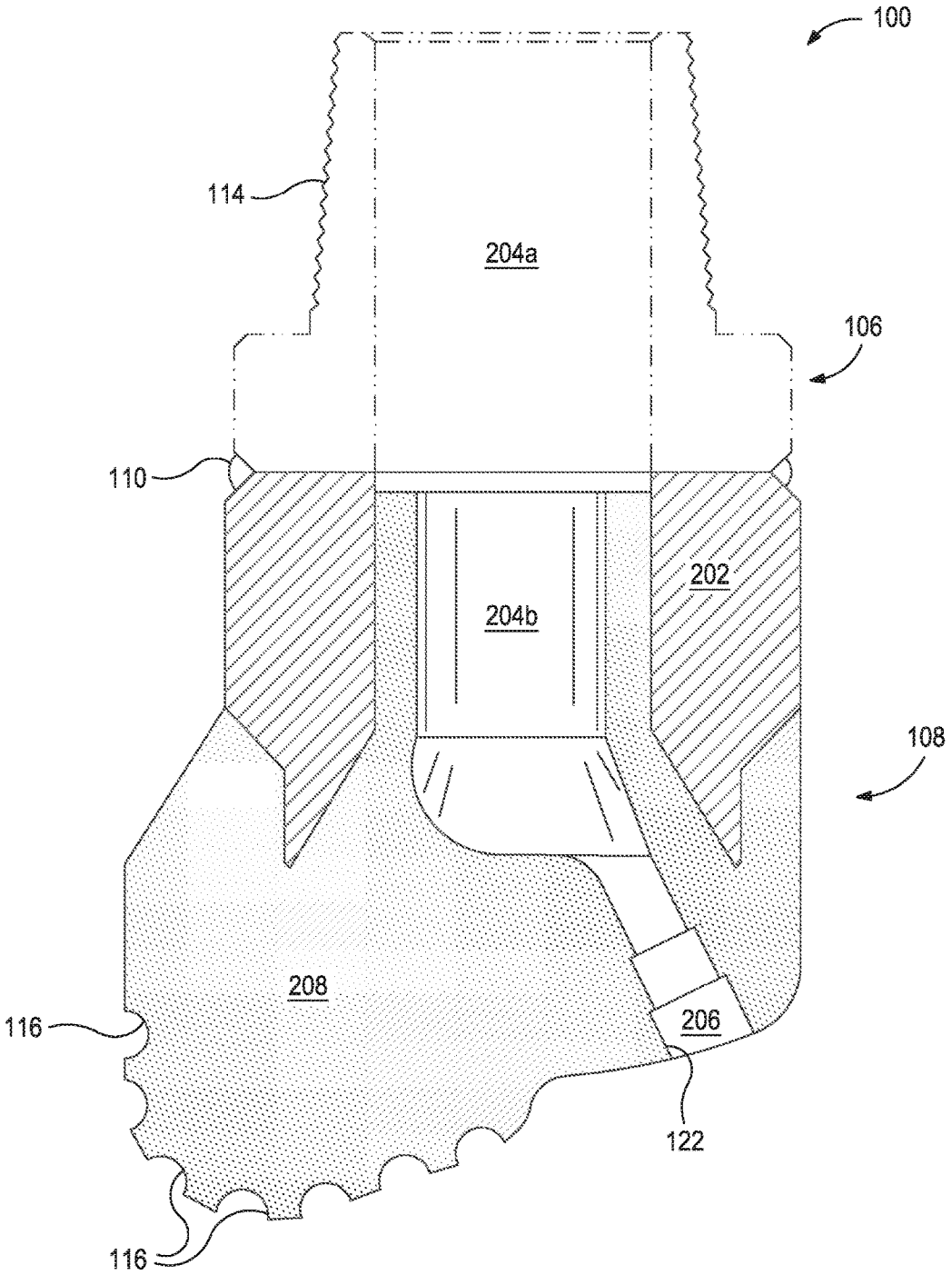
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108.

At least one flow passageway 206 (one shown) may extend from the fluid cavity 204*b* to exterior portions of the bit body 108. The nozzle openings 122 (one shown in FIG. 2) may be defined at the ends of the flow passageways 206 at the exterior portions of the bit body 108. The pockets 116 are formed in the bit body 108 and are shaped or otherwise configured to receive the cutting elements 118 (FIG. 1). The bit body 108 may comprise a hard composite portion 208.

Figure 3:
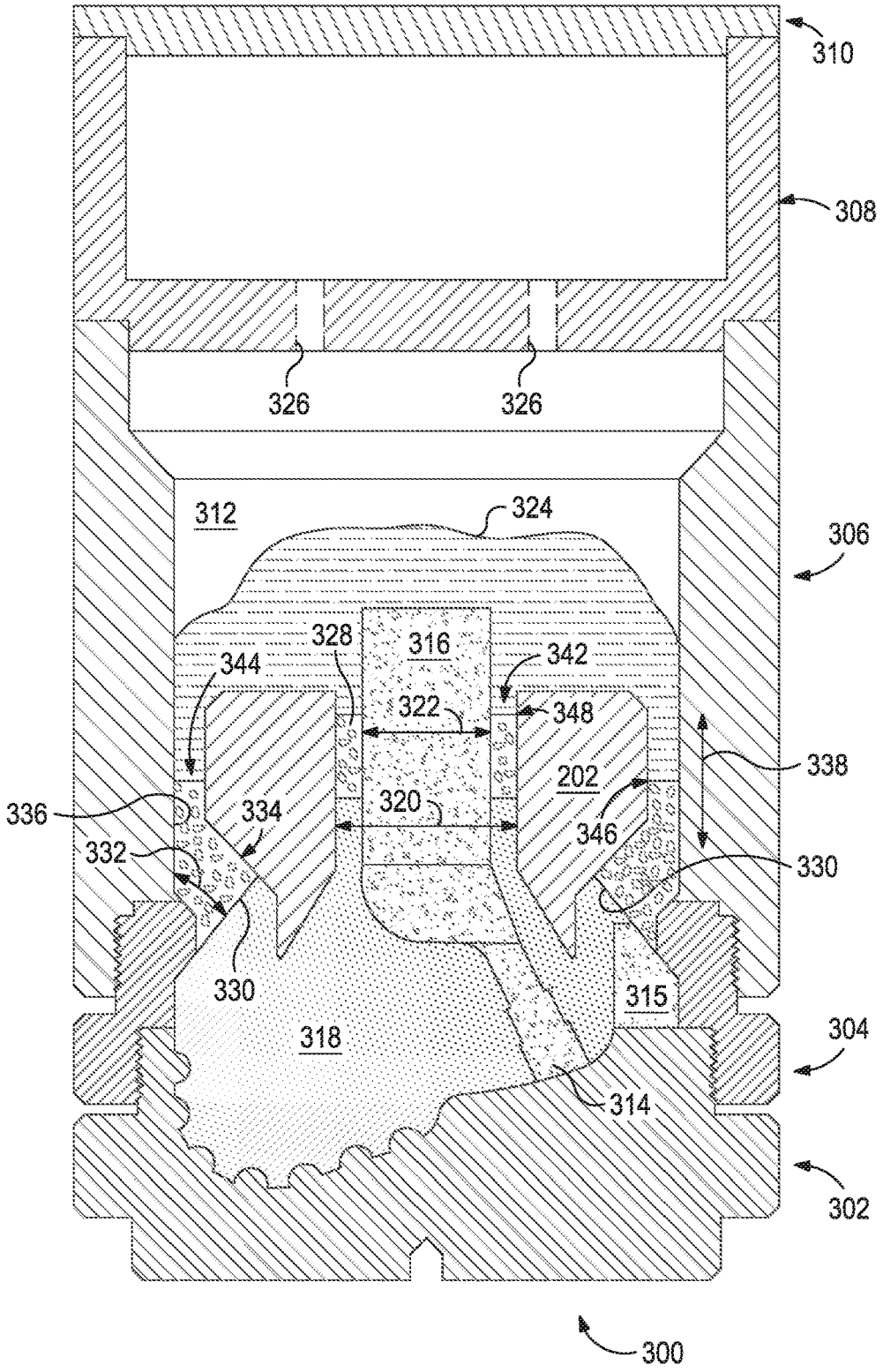
FIG. 3 is a cross-sectional side view of an exemplary mold assembly for use in forming the drill bit of FIG. 1.

FIG. 3 is a cross-sectional side view of a mold assembly that may be used to form the drill bit 100 of FIGS. 1 and 2. While the mold assembly 300 is shown and discussed as being used to help fabricate the drill bit 100, those skilled in the art will readily appreciate that the mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, one or more nozzle displacements or legs 314 (one shown) may be positioned to correspond with desired locations and configurations of the flow passageways 206 (FIG. 2) and their respective nozzle openings 122 (FIGS. 1 and 2). One or more junk slot displacements 315 may also be positioned within the mold assembly 300 to correspond with the junk slots 124 (FIG. 1). Moreover, a cylindrically-shaped central displacement 316 may be placed on the legs 314. The number of legs 314 extending from the central displacement 316 will depend upon the desired number of flow passageways and corresponding nozzle openings 122 in the drill bit 100. Further, cutter-pocket displacements (shown as part of mold 302 in FIG. 3) may be provided in the mold 302 to form the cutter pockets 116 (FIGS. 1 and 2).

After the desired components, including the central displacement 316 and the legs 314, have been installed within the mold assembly 300, reinforcement material 318 may then be placed within or otherwise introduced into the mold assembly 300. As illustrated, the reinforcement material 318 may be used first to fill a first or lower portion of the mold assembly 300. Then, an auxiliary material 328 (sometimes referred to as a "shoulder material" during the molding and assembly of drill bits) may be introduced into the mold assembly 300 and positioned atop the reinforcement material 318.

The metal blank 202 may be supported at least partially by the reinforcement material 318 and the auxiliary material 328 within the infiltration chamber 312. More particularly, after a sufficient volume of the reinforcement material 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. Additional reinforcement material 318 and the auxiliary material 328 may then be filled to a desired level within the infiltration chamber 312.

In the illustrated embodiment, the auxiliary material 328 is placed in two locations within the mold assembly 300. In a first location 342, the auxiliary material 328 is located between the central displacement 316 and an upper portion of the metal blank 202. The top 348 of the auxiliary material 328 in the first location 342 may be within the upper ⅔ to 1/10 of the metal blank 202.

In a second location 344, the auxiliary material 328 is located between the metal blank 202 and the inner wall 336 of the mold assembly 300 such that a boundary 330 between the reinforcement material 318 and the auxiliary material 328 is formed. In the illustrated embodiment, the boundary 330 extends at an upward angle 332 from the inner wall 336 of the mold assembly 300 to the metal blank 202. The angle 332 may be formed, for example, by compacting the reinforcement material 318 to a predetermined slope. In some embodiments the upward angle 332 may be 30° offset from the vertical direction 338 of the inner wall 336, but may alternatively be 90° offset from the vertical direction 338 of the inner wall 336, or any angle therebetween (e.g., 30°-45°, 45°-90°, 40°-60°, 30°-60°, or 60°-90°). In at least one embodiment, the boundary 330 may intersect the metal blank 202 at a beveled portion 334. In some instances, the auxiliary material 328 deposited in the second location 344 may be filled to a top level 346, which may be at any level (i.e., height) along the metal blank 202 to covering the metal blank 202.

In some embodiments, after adding some or all of the auxiliary material 328, the mold assembly 300 and components contained therein may be vibrated to increase the packing density of the reinforcement material 318 and the auxiliary material 328 in their respective locations.

Then, binder material 324 may be placed atop the auxiliary material 328 within the infiltration chamber 312. In some embodiments, the binder material 324 may be covered with a flux layer (not expressly shown). The amount of binder material 324 (and optional flux material) added to the infiltration chamber 312 should be at least enough to infiltrate the reinforcement material 318 and the auxiliary material 328 during the infiltration process. In alternative embodiments, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300.

The mold assembly 300 and the materials disposed therein may then be preheated and then placed in a furnace (not shown). When the furnace temperature reaches the melting point of the binder material 324, the binder material 324 will liquefy and proceed to infiltrate the reinforcement material 318 and the auxiliary material 328. The processing temperature is defined as greater than the melting point of the binder material 324, which is strictly defined as the liquidus point of the alloy composition of the binder material 324, but below the melting point of the reinforcement material 318 and the auxiliary material 328. An exemplary processing temperature is 2000° F. (1093° C.). Other suitable processing temperatures may be between 1500° F. (816° C.) and 3000° F. (1649° C.).

In traditional infiltration of only reinforcement material 318, excess binder material 324 is used to ensure complete infiltration of the reinforcement material 318. This creates a binder-head above the reinforcement material 318 infiltrated with the binder material 324. In some embodiments of the present application, excess auxiliary material 328 may be used to reduce the total amount of binder material 324 needed to produce the desired height in the mold assembly 300 after infiltration. After a predetermined amount of time allotted for the liquefied binder material 324 to infiltrate the reinforcement material 318 and the auxiliary material 328, the mold assembly 300 may then be removed from the furnace and cooled at a controlled rate. Once cooled, the mold assembly 300 may be broken away and the displacement components (e.g., the central displacement 316, the legs 314, and the junk slot displacements 315) removed to produce an infiltrated bit body. Subsequent processing according to well-known techniques may be used to finish the drill bit 100 (FIG. 1). For example, the hard composite produced from infiltrating the auxiliary material 328 with the binder 324 may be machined completely or partially away to produce the bit body 108 (FIGS. 1 and 2).

Figure 4:
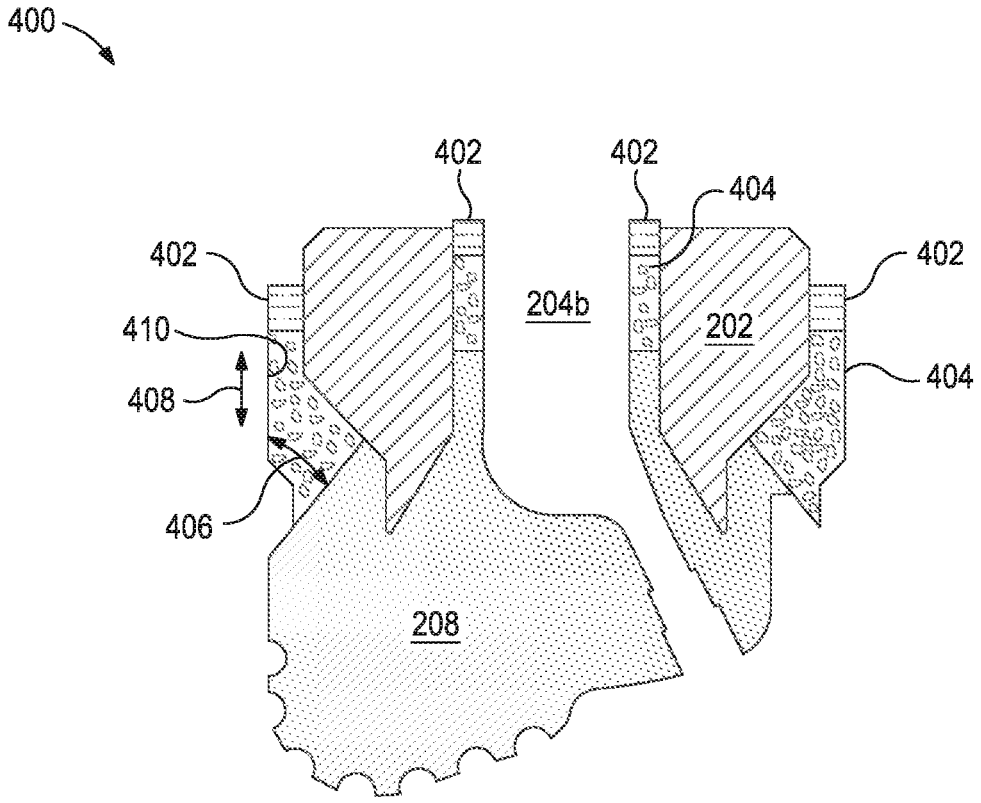
FIG. 4 is a cross-sectional side view of an infiltrated bit body that may be produced from infiltrating the reinforcement material and the auxiliary material with the binder material illustrated in FIG. 3.

FIG. 4 is a cross-sectional side view of an infiltrated bit body 400 that may be produced from infiltrating the reinforcement material 318 and the auxiliary material 328 with the binder material 324 illustrated in FIG. 3. Similar numerals from FIGS. 1-3 that are used in FIG. 4 refer to similar components that are not described again. The infiltrated bit body 400 includes a fluid cavity 204*b* corresponding to the central displacement 316 of FIG. 3, the metal blank 202 disposed about the fluid cavity 204*b*, the hard composite portion 208 formed between a portion of the fluid cavity 204*b* and a portion of the metal blank 202, an auxiliary portion 404 disposed about the metal blank 202 and extending to the hard composite portion 208, and excess solidified binder 402 atop the auxiliary portion 404. The auxiliary portion 404 corresponding to the second location 344 of FIG. 3 may extend toward the metal blank 202 at an upward angle 406 ranging between 30° and 90° a vertical direction 408 of an outer surface 410 of the auxiliary portion.

In alternative embodiments, when excess binder material 324 of FIG. 3 is not used, the excess solidified binder 402 may not be present in the infiltrated bit body 400.

At least a portion of each of the excess solidified binder 402 (if present), at least a portion of the auxiliary portion 404, and a portion of the blank may be removed from the infiltrated bit body 400 by machining, milling, turning operations, or other suitable methods. In some instances, at least 95% by volume of the excess solidified binder 402 and the auxiliary portion 404 may be removed from the infiltrated bit body 400. In some instances, a portion of the hard composite portion 208 may optionally be removed by machining, milling, or other suitable methods.

As described above, additional components (e.g., the shank 106) may be added to the metal blank 202 and hard composite portion 208 to produce the bit body 108 of FIG. 1.

Generally, the reinforcement material 318 and the auxiliary material 328 should be chosen such that the auxiliary portion 404 is more machinable than the hard composite portion 208, which may be determined by erosion resistance, machinability rating, or both. In some embodiments, the hard composite portion 208 have at least ten times greater erosion resistant than the auxiliary portion 404. Erosion resistance may be measured by American Society for Testing and Materials (ASTM) G65-16. Alternatively or in addition to the foregoing, in some embodiments, the auxiliary portion 404 may have a machinability rating (defined above) of 0.6 or greater, and the hard composite portion 208 may have a machinability rating of 0.2 or less.

The reinforcement material 318 may include reinforcing particles, refractory metals, refractory metal alloys, refractory ceramics, or a combination thereof. In some instances, at least 50% by weight of the reinforcement material 318 may comprise reinforcing particles, including any subset thereof (e.g., at least 75% by weight, at least 90% by weight, or at least 95% by weight).

The auxiliary material 328 may include reinforcing particles, refractory metals, refractory metal alloys, refractory ceramics, a non-refractory metal, non-refractory metal alloy, non-refractory ceramic, or a combination thereof. In some instances, less than 50% by weight of the auxiliary material 328 may comprise reinforcing particles, including any subset thereof (e.g., less than 25% by weight, less than 10% by weight, or less than 5% by weight). In some instances, the auxiliary material 328 may include no reinforcing particles.

When the auxiliary material 328 is refractory, the auxiliary portion 404 may be a hard composite comprising the auxiliary material 328 dispersed in the binder material 324. When the auxiliary material 328 is non-refractory, the auxiliary portion 404 may comprise an alloy of the binder material 324 and the auxiliary material 328. In some instances, the auxiliary material 328 may comprise both refractory and non-refractory materials where the resultant auxiliary portion 404 comprises the refractory materials dispersed in an alloy of the binder material 324 and the non-refractory material. In some instances, the auxiliary material 328 may be placed in the mold assembly 300 in layers or a gradient such that refractory materials are at a higher concentration at or near the boundary 330 relative to higher in the mold assembly 300. For example, in some instances, a concentration of the refractory material may be highest in the auxiliary material 328 within 10 cm of the boundary 330 (FIG. 3).

Exemplary reinforcing particles may include, but are not limited to, particles of metals, metal alloys, superalloys, intermetallics, borides, carbides, nitrides, oxides, ceramics, diamonds, and the like, or any combination thereof. More particularly, examples of reinforcing particles suitable for use in conjunction with the embodiments described herein may include particles that include, but are not limited to, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbide (e.g., macrocrystalline tungsten carbide, cast tungsten carbide, crushed sintered tungsten carbide, carburized tungsten carbide, etc.), any mixture thereof, and any combination thereof. In some embodiments, the reinforcing particles may be coated. For example, by way of non-limiting example, the reinforcing particles may comprise diamond coated with titanium.

In some embodiments, the reinforcing particles described herein may have a diameter ranging from a lower limit of 1 micron, 10 microns, 50 microns, or 100 microns to an upper limit of 1000 microns, 800 microns, 500 microns, 400 microns, or 200 microns, wherein the diameter of the reinforcing particles may range from any lower limit to any upper limit and encompasses any subset therebetween.

The distinction between refractory and non-refractory materials (e.g., metals, metal alloys, ceramics, etc.) depends on the processing temperature of the infiltration process. For example, at an infiltration processing temperature of 2000° F. (1093° C.), tungsten is a refractory metal and silver is a non-refractory metal. Accordingly, the present applications provides exemplary materials for the metals, metal alloys, and ceramics that may be used in the reinforcing material 318 and/or the auxiliary material 328 and one skilled in the art would know to select an infiltration processing temperature to cause the chosen materials to melt (i.e., used as non-refractory materials) or to not melt (i.e., used as refractory materials). As used herein, the terms "metal," metal-alloy," and "ceramic" encompass both the refractory and non-refractory materials unless otherwise specified by an infiltration processing temperature.

Exemplary metals may include, but are not limited to, tungsten, rhenium, osmium, tantalum, molybdenum, niobium, iridium, ruthenium, hafnium, boron, rhodium, vanadium, chromium, zirconium, platinum, titanium, lutetium, palladium, thulium, scandium, iron, yttrium, erbium, cobalt, holmium, nickel, silicon, dysprosium, terbium, gadolinium, beryllium, manganese, uranium, copper, samarium, gold, neodymium, silver, germanium, praseodymium, lanthanum, calcium, europium, ytterbium, tin, zinc, or a non-alloyed combination thereof.

In some instances, the metal alloys may be alloys of the foregoing metals. Exemplary metal alloys may include, but are not limited to, tantalum-tungsten, tantalum-tungsten-molybdenum, tantalum-tungsten-rhenium, tantalum-tungsten-molybdenum-rhenium, tantalum-tungsten-zirconium, tungsten-rhenium, tungsten-molybdenum, tungsten-rhenium-molybdenum, tungsten-molybdenum-hafnium, tungsten-molybdenum-zirconium, tungsten-ruthenium, niobium-vanadium, niobium-vanadium-titanium, niobium-zirconium, niobium-tungsten-zirconium, niobium-hafnium-titanium, niobium-tungsten-hafnium, copper-nickel, copper-zinc (brass), copper-tin (bronze), copper-manganese-phosphorous, nickel-aluminum, nickel-chromium, nickel-iron, nickel-cobalt-iron, titanium-aluminum-vanadium, cobalt-iron-vanadium, and any combination thereof. Additionally, example metal alloys include alloys wherein any of the aforementioned metals is the most prevalent element in the alloy. Examples for tungsten-based alloys where tungsten is the most prevalent element in the alloy include tungsten-copper, tungsten-nickel-copper, tungsten-nickel-iron, tungsten-nickel-copper-iron, and tungsten-nickel-iron-molybdenum. Examples for nickel-based alloys where nickel is the most prevalent element in the alloy include nickel-copper, nickel-chromium, nickel-chromium-iron, nickel-chromium-molybdenum, nickel-molybdenum, HASTELLOY® alloys (i.e., nickel-chromium containing alloys, available from Haynes International), INCONEL® alloys (i.e., austenitic nickel-chromium containing superalloys available from Special Metals Corporation), WASPALOYS® austenitic nickel-based superalloys), RENE® alloys (i.e., nickel-chromium containing alloys available from Altemp Alloys, Inc.), HAYNES® alloys (i.e., nickel-chromium containing superalloys available from Haynes International), MP98T (i.e., a nickel-copper-chromium superalloy available from SPS Technologies), TMS alloys, CMSX® alloys (i.e., nickel-based superalloys available from C-M Group). Example iron-based alloys include steels, stainless steels, carbon steels, austenitic steels, ferritic steels, martensitic steels, precipitation-hardening steels, duplex stainless steels, and hypo-eutectoid steels. Example iron-nickel-based alloys include INCOLOY® alloys (i.e., iron-nickel containing superalloys available from Mega Mex), INVAR™ (i.e., a nickel-iron alloy FeNi36 (64FeNi in the US), available from Imphy Alloys), and KOVAR™ (a nickel-cobalt ferrous alloy, available from CRS Holdings, Inc.), and hyper-eutectoid steels.

Exemplary ceramics may include, but are not limited to, glass, aluminum oxide, boron carbide, calcium oxide, silicon carbide, titanium carbide, boron nitride, silicon nitride, titanium nitride, yttrium oxide, zirconium oxide, nickel oxide, magnesium oxide, phosphorous oxide, iron oxide, glass, and the like, or any combination thereof (e.g., SHAPAL™, a combination of aluminum nitride and boron nitride, available from Goodfellow Ceramics). In some instances, the glass may be a machinable glass like MACOR™ (available from Corning).

Exemplary other materials that may be included in the auxiliary material may include, but are not limited to, graphite, mica, barite, wollastonite, sand, slag, salt, and the like, or any combination thereof.

In instances where a specific component of the auxiliary material 328 is not wettable by the binder material 324, the component of the auxiliary material 328 may be coated with a metal to provide a wettable surface for the binder material 324 during infiltration (e.g., nickel-coated graphite).

In some embodiments, the components of the auxiliary material 328 may have a diameter of 0.5 micron to 16 mm, including subsets thereof (e.g., 0.5 microns to 100 microns, 250 microns to 1000 microns, 500 microns to 5 mm, or 1 mm to 16 mm). The components of the auxiliary material 328 may comprise material in the form of powder, particulate, shot, or a combination of any of the foregoing. As used herein, the term "shot" refers to particles having a diameter greater than 4 mm (e.g., greater than 4 mm to 16 mm). As used herein, the term "particulate" refers to particles having a diameter of 250 microns to 4 mm. As used herein, the term "powder" refers to particles having a diameter less than 250 microns (e.g., 0.5 microns to less than 250 microns).

Additionally, in some instances, the components of the auxiliary material 328 may optionally further include a salt, slag, glass, or the like that becomes molten during infiltration provided that the auxiliary material 328 when molten floats to the top and allows the binder material 324 to flow readily therethrough.

Binder material 324 may then be placed on top of the reinforcement material 318, the metal blank 202, and the central displacement 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 324 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling.

Embodiments described herein include, but are not limited to, Embodiments A, B, and C.

Embodiment A is a method of fabricating a metal matrix composite (MMC) tool, the method comprising: depositing an amount of reinforcement material within an infiltration chamber defined by a mold assembly, the mold assembly containing a central displacement and a metal blank disposed about the central displacement and thereby defining a first location between the central displacement and an upper portion of the metal blank, and a second location between the metal blank and an inner wall of the mold assembly; depositing an auxiliary material comprising a refractory material within the infiltration chamber atop the reinforcement material and into the first and second locations, wherein a boundary between the reinforcement material and the auxiliary material at the second location extends from the mold assembly to the metal blank at an upward angle ranging between 30° and 90° relative vertical (e.g., to a vertical direction of the inner wall of the mold assembly); infiltrating the reinforcement material with a binder material to form a hard composite portion having a machinability rating of 0.2 or less; and infiltrating the auxiliary material with the binder material to form an auxiliary portion having a rating of 0.6 or greater. Optionally, Embodiment A may further include one or more of the following: Element 1: wherein the hard composite portion is at least ten times more erosion resistant than the auxiliary portion; Element 2: the method further comprising vibrating the mold assembly after depositing the auxiliary material within the infiltration chamber atop the reinforcement material; Element 3: wherein the refractory material comprises one selected from the group consisting of a refractory metal, a refractory alloy, a refractory ceramic, and any combination thereof; Element 4: the method further comprising machining at least a portion of the auxiliary portion; Element 5: wherein the auxiliary material further comprises a non-refractory material that alloys with the binder material when infiltrating the auxiliary material; Element 6: Element 5 and wherein a concentration of the refractory material is highest in the auxiliary material within 10 cm of the boundary; Element 7: wherein the auxiliary material has a diameter of 0.5 micron to 16 mm (including any subset thereof); and Element 8: wherein the auxiliary material comprises shot. Exemplary combinations may include, but are not limited to, Element 1 in combination with one or more of Elements 2-8, Element 2 in combination with one or more of Elements 3-8, Element 3 in combination with one or more of Elements 4-8, Element 4 in combination with one or more of Elements 5-8, and Element 5 in combination with one or more of Elements 6-8.

Embodiment B is a method of fabricating a metal matrix composite (MMC) tool, the method comprising: depositing an amount of reinforcement material within an infiltration chamber defined by a mold assembly, the mold assembly containing a central displacement and a metal blank disposed about the central displacement and thereby defining a first location between the central displacement and an upper portion of the metal blank, and a second location between the metal blank and an inner wall of the mold assembly; depositing an auxiliary material comprising a non-refractory material within the infiltration chamber atop the reinforcement material and into the first and second locations, wherein a boundary between the reinforcement material and the auxiliary material in the second location extends from the mold assembly to the metal blank at an upward angle ranging between 30° and 90° relative to vertical (e.g., a vertical direction of the inner wall of the mold assembly); infiltrating the reinforcement material with a binder material to form a hard composite portion having a machinability rating of 0.2 or less; and alloying the binder material and the non-refractory material to form an auxiliary portion having a machinability rating of 0.6 or greater. Optionally, Embodiment B may further include one or more of the following: Element 1; Element 9: the method further comprising vibrating the mold assembly after depositing the auxiliary material within the infiltration chamber atop the reinforcement material; Element 10: wherein the non-refractory material comprises one selected from the group consisting of a non-refractory metal, a non-refractory alloy, a non-refractory ceramic, and any combination thereof; Element 11: the method further comprising machining at least a portion of the auxiliary portion; Element 12: wherein the auxiliary material further comprises a non-refractory material and the auxiliary portion comprises the non-refractory material dispersed in an alloy produced from alloying the binder material and the non-refractory material; Element 13: Element 12 and wherein a concentration of the refractory material is highest in the auxiliary material within 10 cm of the boundary; Element 14: wherein the auxiliary material has a diameter of 0.5 micron to 16 mm; and Element 15: wherein the auxiliary material comprises shot. Exemplary combinations may include, but are not limited to, Element 1 in combination with one or more of Elements 9-15, Element 9 in combination with one or more of Elements 10-15, Element 10 in combination with one or more of Elements 11-15, Element 11 in combination with one or more of Elements 12-15, and Element 12 in combination with one or more of Elements 13-15.

Embodiment C is an infiltrated bit body comprising: a fluid cavity; a metal blank disposed about the fluid cavity; a hard composite portion having a machinability rating of 0.2 or less and formed between a portion of the fluid cavity and a portion of the metal blank; an auxiliary portion having a machinability rating of 0.6 or greater disposed about the metal blank and extending to the hard composite portion such that a boundary between the hard composite portion and the auxiliary portion extends toward the metal blank at an upward angle ranging between 30° and 90° a vertical direction of an outer surface of the auxiliary portion. Optionally, Embodiment C may further include one or more of the following: Element 1; Element 16: wherein the auxiliary portion comprise an auxiliary material dispersed in a binder material, and wherein the auxiliary material comprises one selected from the group consisting of: a refractory metal, a refractory alloy, a refractory ceramic, and any combination thereof; Element 17: wherein the auxiliary portion comprises an alloy between an auxiliary material and a binder material, and wherein the auxiliary material comprises one selected from the group consisting of: a non-refractory metal, a non-refractory alloy, a non-refractory ceramic, and any combination thereof; and Element 18: wherein the auxiliary portion comprises a refractory material dispersed in an alloy of a binder material and a non-refractory material, wherein a concentration of the refractory material in the auxiliary portion is highest in the auxiliary material within 10 cm of the boundary. Exemplary combinations may include, but are not limited to, Element 16 in combination with Element 17 and optionally in further combination with Element 18; Element 16 in combination with Element 18; Element 17 in combination with Element 18; and Element 1 in combination with one or more of Elements 16-18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method of fabricating a metal matrix composite (MMC) tool, the method comprising:

depositing an amount of reinforcement material within an infiltration chamber defined by a mold assembly, the mold assembly containing a central displacement and a metal blank disposed about the central displacement and thereby defining a first location between the central displacement and an upper portion of the metal blank, and a second location between the metal blank and an inner wall of the mold assembly;

depositing an auxiliary material comprising a refractory material into the first and second locations, such that a boundary between the reinforcement material and the auxiliary material in the second location extends from the mold assembly to the metal blank at an upward angle ranging between 30° and 90° relative to vertical;

infiltrating the reinforcement material with a binder material to form a hard composite portion having a machinability rating of 0.2 or less; and infiltrating the auxiliary material with the binder material to form an auxiliary portion having a machinability rating of 0.6 or greater.

2. The method of claim 1, wherein the hard composite portion is at least ten times more erosion resistant than the auxiliary portion.

3. The method of claim 1 further comprising: vibrating the mold assembly after depositing the auxiliary material within the infiltration chamber atop the reinforcement material.

4. The method of claim 1, wherein the refractory material comprises one selected from the group consisting of a refractory metal, a refractory alloy, a refractory ceramic, and any combination thereof.

5. The method of claim 4 further comprising: machining at least a portion of the auxiliary portion.

6. The method of claim 1, wherein the auxiliary material further comprises a refractory material that alloys with the binder material when infiltrating the auxiliary material.

7. The method of claim 6, wherein a concentration of the refractory material is highest in the auxiliary material within 10 cm of the boundary.

8. The method of claim 1, wherein the auxiliary material has a diameter of 0.5 micron to 16 mm.

9. A method of fabricating a metal matrix composite (MMC) tool, the method comprising:

depositing an amount of reinforcement material within an infiltration chamber defined by a mold assembly, the mold assembly containing a central displacement and a metal blank disposed about the central displacement and thereby defining a first location between the central displacement and an upper portion of the metal blank, and a second location between the metal blank and an inner wall of the mold assembly;

depositing an auxiliary material comprising a non-refractory material into the first and second locations, such that a boundary between the reinforcement material and the auxiliary material in the second location extends from the mold assembly to the metal blank at an upward angle ranging between 30° and 90° relative to vertical;

infiltrating the reinforcement material with a binder material to form a hard composite portion having a machinability rating of 0.2 or less; and alloying the binder material and the non-refractory material to form an auxiliary portion having a machinability rating of 0.6 or greater.

10. The method of claim 9, wherein the hard composite portion is at least ten times more erosion resistant than the auxiliary portion.

11. The method of claim 9 further comprising: vibrating the mold assembly after depositing the auxiliary material within the infiltration chamber atop the reinforcement material.

12. The method of claim 9, wherein the non-refractory material comprises one selected from the group consisting of a non-refractory metal, a non-refractory alloy, a non-refractory ceramic, and any combination thereof.

13. The method of claim 9 further comprising: machining at least a portion of the auxiliary portion.

14. The method of claim 9, wherein the auxiliary material further comprises a non-refractory material and the auxiliary portion comprises the non-refractory material dispersed in an alloy produced from alloying the binder material and the non-refractory material.

15. The method of claim 14, wherein a concentration of the non-refractory material is highest in the auxiliary material within 10 cm of the boundary.

16. The method of claim 9, wherein the auxiliary material has a diameter of 0.5 micron to 16 mm.

* * * * *